US005429249A

United States Patent [19]

Belec et al.

[11] Patent Number: 5,429,249

[45] Date of Patent: Jul. 4, 1995

[54] ON-LINE SORTING FOR AN INSERTER SYSTEM

[75] Inventors: Eric A. Belec; Cheryl L. Picoult, both of Southbury, Conn.

[73] Assignee: Pitney Bowes Inc., Stamford, Conn.

[21] Appl. No.: 152,788

[22] Filed: Nov. 15, 1993

[51] Int. Cl.[6] ..... B07C 5/00

[52] U.S. Cl. ..... 209/584; 209/900

[58] Field of Search ..... 209/584, 583, 900; 271/185, 184, 298; 198/405

[56] References Cited

U.S. PATENT DOCUMENTS

| | | | |
|---|---|---|---|
| 4,330,116 | 5/1982 | Newsome | 271/185 X |
| 4,547,846 | 10/1985 | Gottlieb | 209/900 X |
| 4,705,157 | 11/1987 | Bowles | 198/405 |
| 4,718,660 | 1/1988 | Daboub . | |
| 4,778,062 | 10/1988 | Pavie . | |
| 4,809,187 | 2/1989 | Adams | 209/900 X |
| 4,863,037 | 9/1989 | Stevens et al. . | |
| 4,991,914 | 2/1991 | Kerstein . | |
| 5,119,954 | 6/1992 | Svyatsky et al. . | |
| 5,224,697 | 7/1993 | Darchis et al. . | |
| 5,226,547 | 7/1993 | Malatesta | 209/584 X |
| 5,233,814 | 9/1993 | Bergerioux . | |
| 5,244,344 | 9/1993 | Doeberl et al. . | |
| 5,245,547 | 9/1993 | Ramsey . | |
| 5,292,008 | 3/1994 | Sansone et al. | 209/584 |
| 5,329,102 | 7/1994 | Sansone | 209/584 |

FOREIGN PATENT DOCUMENTS

| | | | |
|---|---|---|---|
| 1234629 | 2/1967 | Germany | 198/405 |

*Primary Examiner*—David H. Bollinger

*Attorney, Agent, or Firm*—Charles R. Malandra, Jr.; Melvin J. Scolnick

[57] ABSTRACT

The present invention provides an inserter based system that performs automated sorting of mailpieces in accordance with predetermined postal discount requirements. The system comprises an inserter for assembling the mailpieces and a sorter coupled to the inserter. The sorter includes a sorter controller and a plurality of on-edge sorting bins. The system also includes communicating mailpiece data and configuration data to the sorter controller. The sorter controller controls the sorting of mailpieces received from the inserter into sort groups according to postal discount requirements. A turn-up and alignment device and a vertical transport are located between the inserter and the sorter. The turn-up and alignment device turns the mailpieces from a horizontal alignment out of the inserter to a vertical alignment. The vertical transport transports the mailpieces on-edge to the sorter. The sorter further includes a scanner for scanning codes printed on the mailpieces. The sorter controller uses data from the scanned codes for sorting the mailpieces to designated sort bins.

5 Claims, 6 Drawing Sheets

ON-LINE SORTING FOR AN INSERTER SYSTEM

FIELD OF THE INVENTION

The invention disclosed herein relates generally to inserting systems, and more particularly, to apparatus for processing the output of inserting equipment.

RELATED APPLICATIONS

The present application is related to U.S. application Ser. Nos. 08/152,802, now U.S. Pat. No. 5,368,287, 08/152,791, 08/152,793, 08/152,790 and 08/152,787 filed concurrently herewith and assigned to the assignee of the present invention.

BACKGROUND OF THE INVENTION

High volume mailers receive discounts in postal rates for meeting certain criteria established by a postal service. Generally, such criterion relates to a reduction in the postal service's handling of the mail from the mailers. The United States Postal Service ("USPS") offers several levels of discounts to mailers. The level of discount typically is based on the number of criteria met by the mailer. For example, in order to maximize such postage discounts, the USPS requires that high volume mailers presort the mailpieces, apply a Zip+4 bar code to each mailpiece, and package their mail into trays with each tray tagged in accordance with the Domestic Mail Manual. Previously, the sorting and traying processes required to qualify for postal discounts have not been performed on an inserter system because such inserters having such capability have not existed. Large volume mailers have performed the sorting process on conventional off-line sorting equipment, however, the traying process is done manually. Smaller volume mailers may perform both the sorting and traying processes manually. In any event, the traying process must be done manually because up to now the traying process has not been automated.

It is well known to couple conventional stacking equipment to the end of an inserter. Generally, such stacking equipment is used to perform a basic stacking of mailpieces assembled by the inserter.

Although off-line sorting with conventional sorting equipment has worked well, basic problems exist which are typically associated with off-line processing versus on-line processing. For example, the integrity of the sorting performed by conventional sorting equipment relies on a scan of data printed on each mailpiece which is used to determine how the sorting equipment will sort the mailpiece. Thus, any error occurring in the scanning of such data effects the sorting process. Previously, there has not been any multi-bin sorting equipment that can be coupled to an inserter for performing on-line sorting functions that meet requirements for postal discounts.

It is an object of the present invention to provide a sorting device that can interface directly with an inserter system for obtaining certain levels of postal discounts.

It is a further object of the present invention to provide an inserter system that includes sorting capability that meets postal service requirements for postal discounts.

SUMMARY OF THE INVENTION

The present invention provides a system and apparatus for assembling and sorting mailpieces according to requirements for receiving postal discounts. The system comprises a conventional inserter that outputs mailpieces to an on-edge, multi-bin sorter/stacker by way of a turn-up and alignment device and vertical transport. The turn-up and alignment device receives the mailpieces in a top edge, registered, horizontal orientation and deposits the mailpieces in a vertical orientation with its bottom edge registered against a fixed surface. The on-edge, multi-bin sorter/stacker, which sorts and stacks substantial quantities of mail in a vertical, on-edge orientation, includes a deck having a deck surface with a low coefficient of friction is tilted at a specific angle to balance forces applied to the mailpieces being stacked regardless on the size and weight of the mailpieces In accordance with the present invention an inserter based system performs automated sorting of mailpieces in accordance with predetermined postal discount requirements. The system comprises an inserter for assembling the mailpieces and a sorter coupled to the inserter. The sorter includes a sorter controller and a plurality of on-edge sorting bins. The system also includes means for communicating mailpiece data and configuration data to the sorter controller. The sorter controller controls the sorting of mailpieces received from the inserter into sort groups according to postal discount requirements.

The system further comprises a turn-up and alignment device and a vertical transport located between the inserter and the sorter. The turn-up and alignment device turns the mailpieces from a horizontal alignment out of the inserter to a vertical alignment. The vertical transport transports the mailpieces on-edge to the sorter. The sorter further includes a sort tag printer for printing a sort tag when the sort controller determines that a stack of mailpieces in one of the stacking bins qualifies for a postal discount. The sorter further includes a scanner for scanning codes printed on the mailpieces. The sorter controller uses data from the scanned codes for sorting the mailpieces to designated sort bins.

A scanner in the inserter scans codes printed on the mailpieces, the inserter including an inserter controller that sends data obtained from the scanned codes to the sorter controller. The sorter controller uses data from the scanned codes for sorting the mailpieces to designated sort bins.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
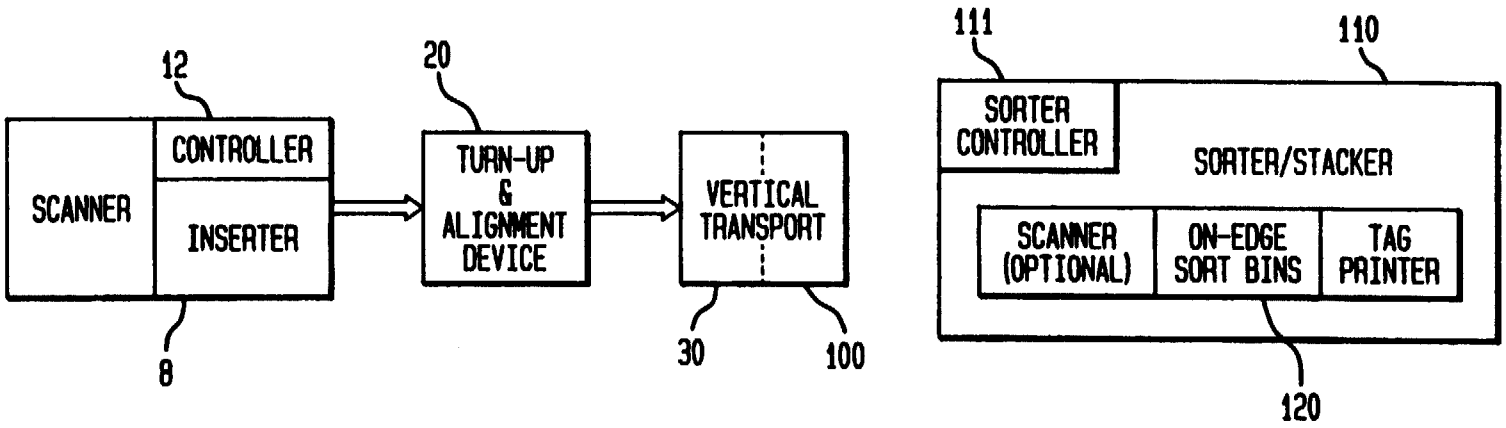
FIG. 1 is a block diagram of an inserter system including an on-line sorting module in accordance with the present invention.

In describing the present invention, reference is made to the drawings, wherein there is seen in FIG. 1 a block diagram of an inserter system, generally designated 1, which includes an on-line sorting function. Inserter system 5 comprises an inserter 8 that outputs mailpieces to a turn-up and alignment device 20 that turns the mailpieces on edge, bottom edge aligned. Vertical transports 30 and 100 transport the mailpieces to an on-edge sorter/stacker 110. A controller 12 of inserter 10 communicates to a controller 111 of sorter 110 whereby sorter 110 sorts the mailpieces according to requirements for postal discounts.

Figure 2:
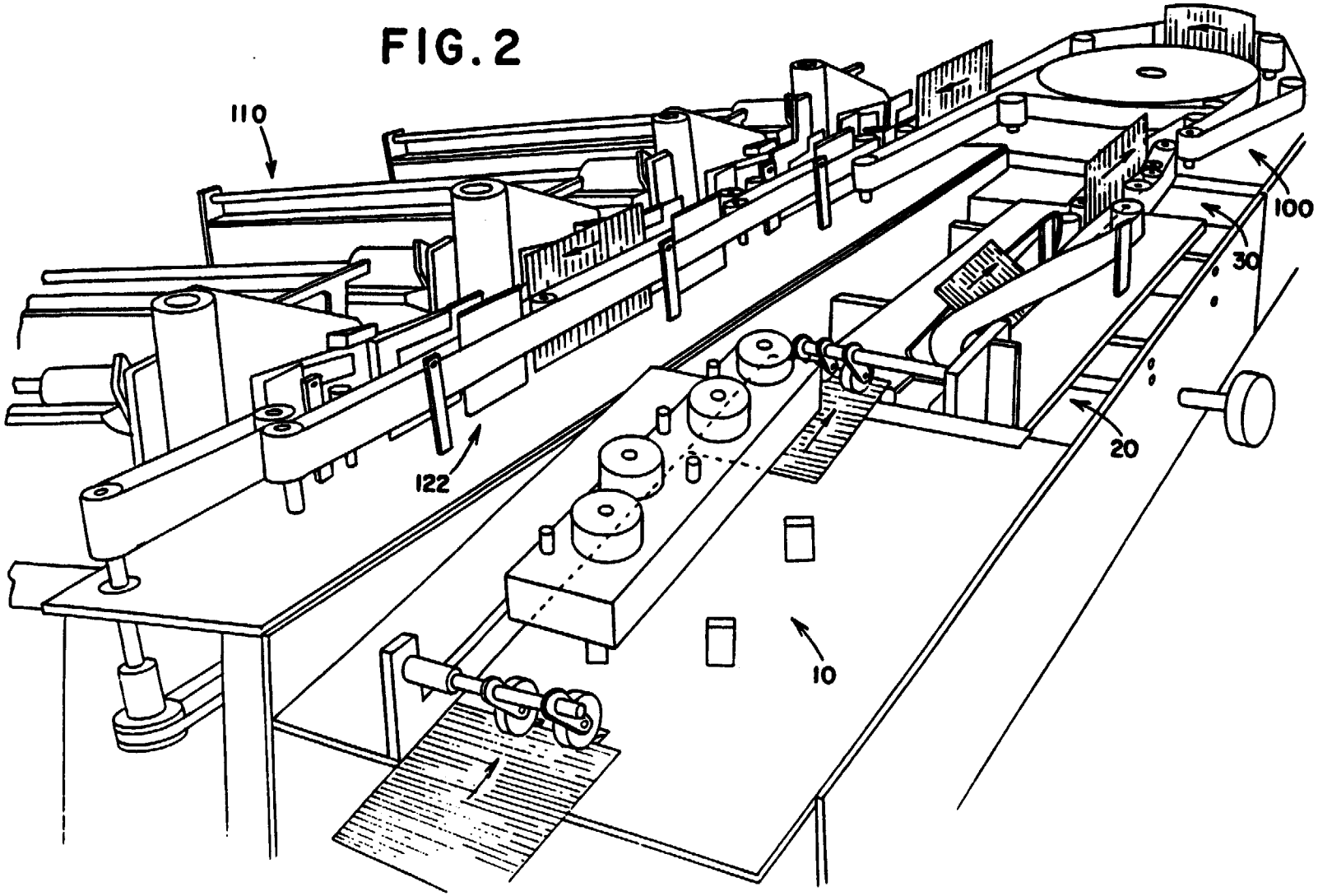
FIG. 2 is a perspective view of the on-line sorting module of FIG. 1 and transports leading thereto.

Referring now to FIG. 2, a series of modules are connected to perform on-line sorting of mailpieces output from an inserter or other mail finishing equipment. A top-edge alignment module 10 is connected to the output end of an inserter (not shown). Module 10 receives mailpieces from the inserter in a horizontal orientation, maintains top-edge registration of the mailpieces and delivers the mailpieces to a turn-up and alignment module 20 that is coupled to the output end of alignment module 10. Turn-up and alignment module 20 is adjustably positioned to obtain bottom-edge registration of the mailpieces while turning the mailpieces 90 degrees to a vertical orientation. Coupled to the exit of turn-up and alignment module 20 is a stationary vertical transport 30 that transports the mailpieces to a drum transport 100. Drum transport 100 is a vertical transport that moves the mailpieces along a U-shaped path to a sorter/stacker module 110.

Figure 3:
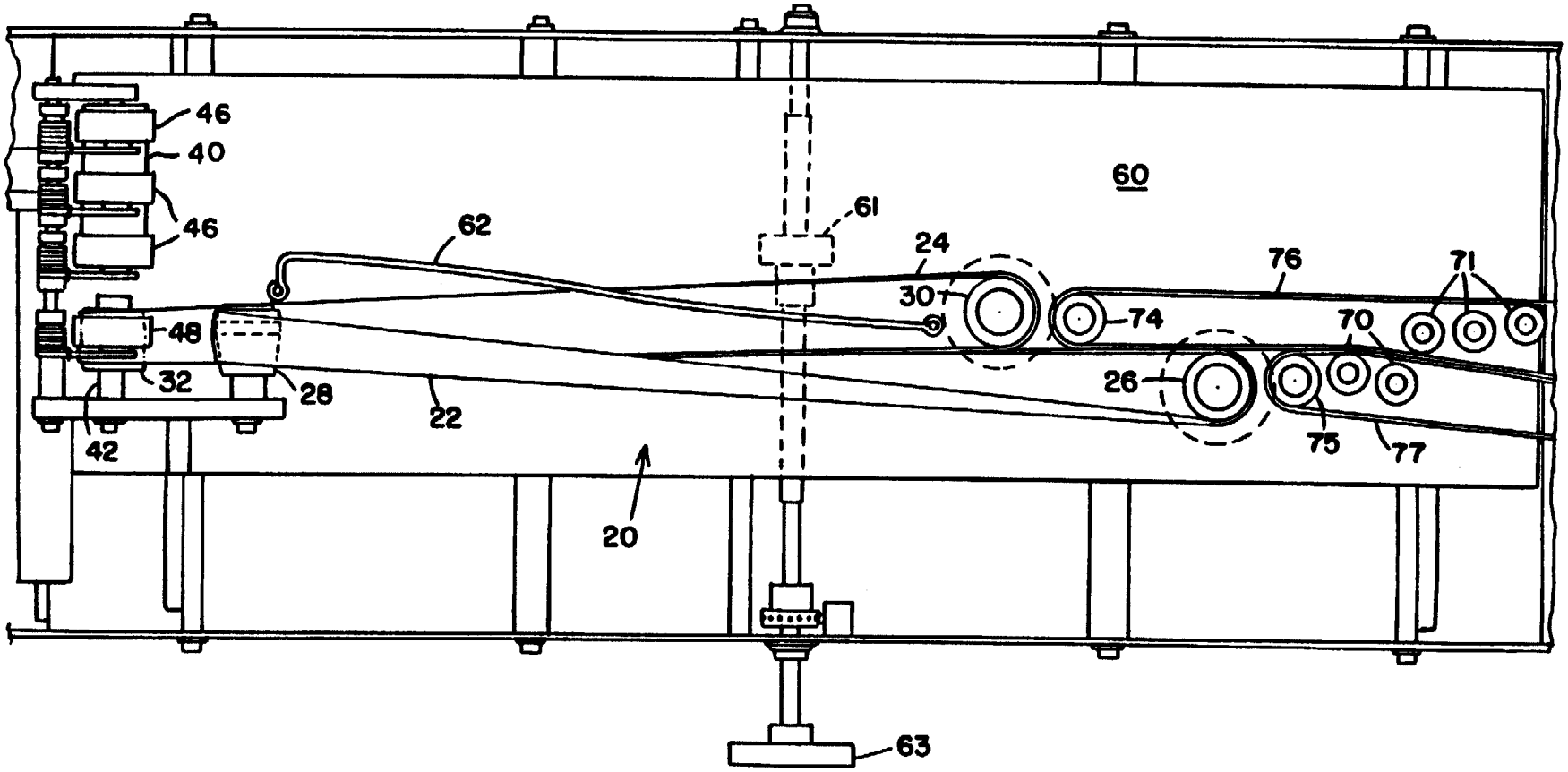
FIG. 3 is a top view of a turn-up and alignment transport of the transports in FIG. 2.

Referring now to FIG. 3, turn-up and alignment module 20 includes a pair of entrance pulleys 28 and 32, each of which has an offset crown and rotates on a stationary horizontal axis, and a pair of exit pulleys 26 o and 30, each of which has a centerline crown. Entrance pulleys 28 and 32 are located longitudinally and vertically apart from one another such that one of the entrance pulleys 32 functions as lower entrance pulley and the other entrance pulley 28 functions as an upper entrance pulley, with upper entrance pulley 28 being located downstream from lower entrance pulley 32. Exit pulleys 26 and 30 rotate on a stationary vertical axis. Exit pulley 26 is located downstream from exit pulley 30. Turn-up and alignment module 20 further includes a pair of elastic, endless belts 22 and 24. Belt 24 is wrapped around lower entrance pulley 32 and upstream exit pulley 30. Belt 22 is wrapped around upper entrance pulley 28 and downstream exit pulley 26, whereby belts 22 and 24 complete a 90 degree twist from their respective entrance pulley to their respective exit pulley such that belts 22 and 24 each has a contiguous span for approximately the entire 90 degree twist against which a corresponding span of the other belt applies a normal force. Turn-up and alignment module 20 further includes a contour wire guide 62 shaped to guide a portion of the flat article that is extending beyond the grip of the first and second belts through the ninety degree twist. A lower entrance roller 40 is adjacent lower entrance pulley 32 and rotates on the same horizontal axis as lower pulley 32. There are a plurality of idler rollers 46 and 48 biased against lower entrance roller 40 and lower idler pulley 32.

A more detailed description of turn-up and alignment module 20 and the transporting of the mailpieces from the inserter to sorter/stacker 110 is disclosed in U.S. patent applications Ser. Nos. 08/152,791 and 08/152,793, previously noted as related application, and hereby incorporated by reference.

Figure 4:
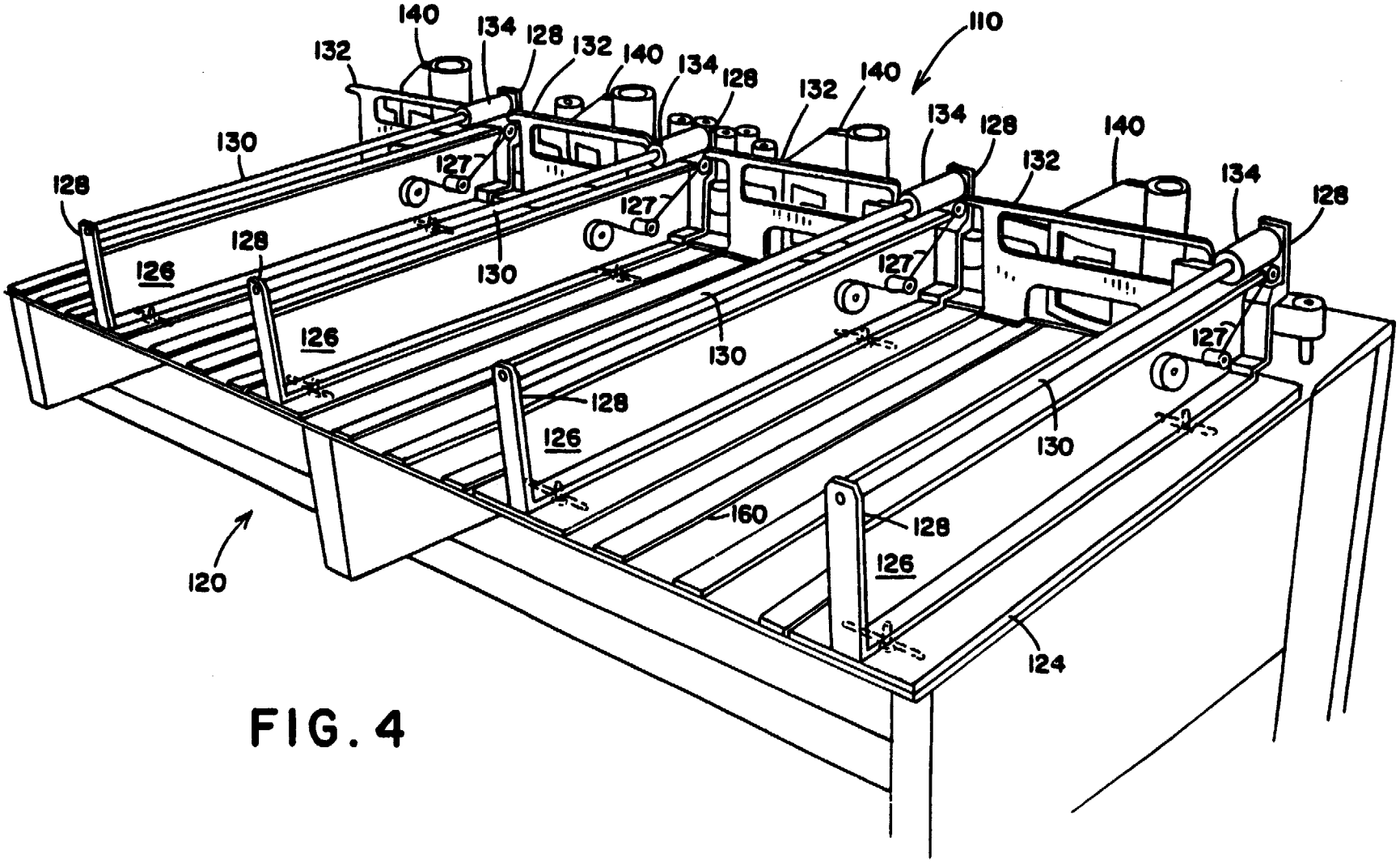
FIG. 4 is a perspective view of bins in the on-line sorting module of FIG. 1.
Figure 5:
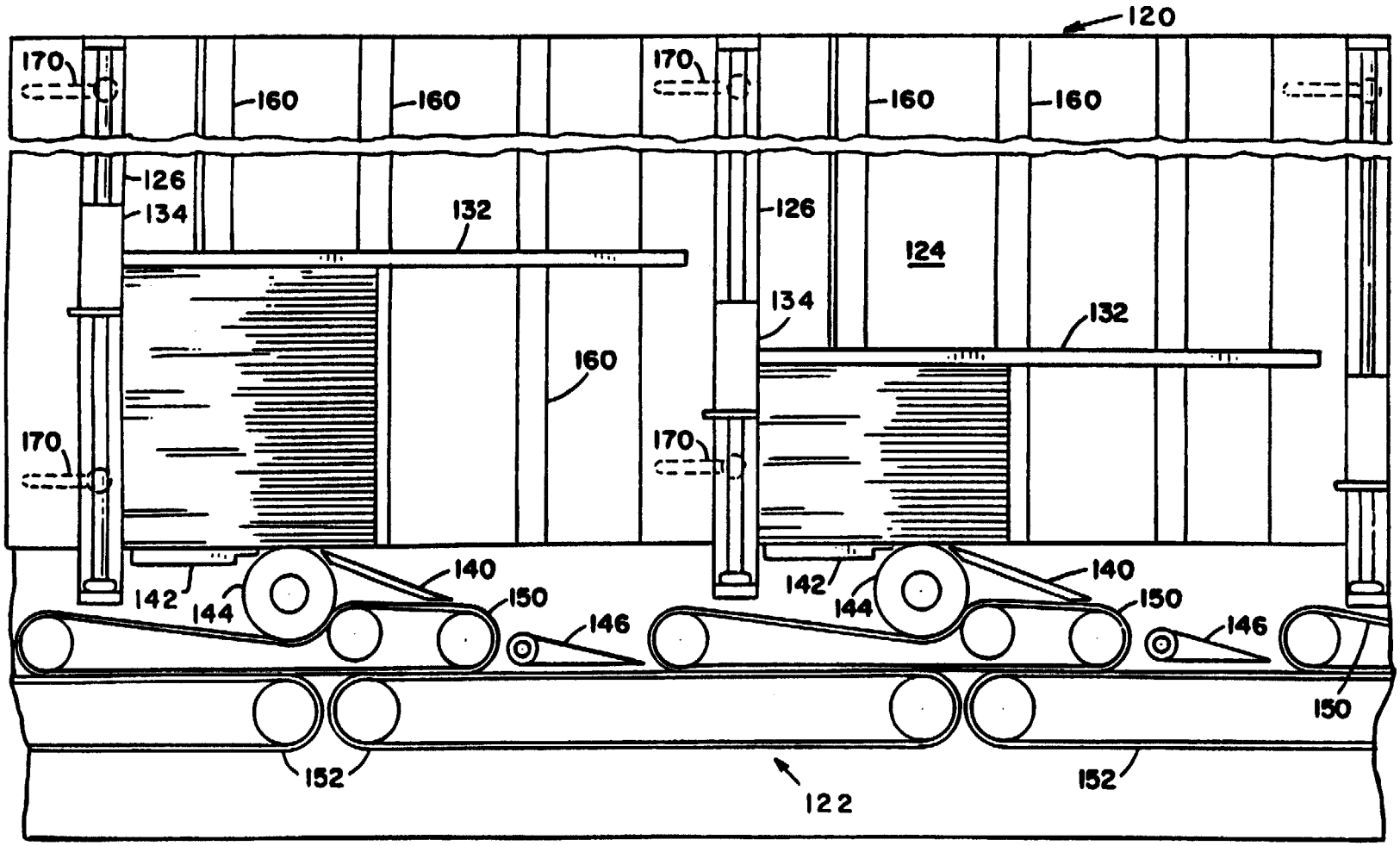
FIG. 5 is a top view of the on-line sorting module of FIG. 1.

Referring now to FIGS. 4 and 5, sorter/stacker 110 includes a plurality of bins, generally designated 120, and a vertical transport, generally designated 122. Bins 120 include a base plate 124 and a plurality of registration walls 126 that are mounted to base plate 124. Registration walls 126 divide base plate 124 into separate bin sections. In the preferred embodiment of the present invention, four registration walls 126 are mounted at certain intervals along base plate 124 to make four separate bins. Each of registration walls 126 includes a pair of end members 128 having a section thereof extending above the top of registration wall 126. Each registration wall 126 has a bar 130 that longitudinally extends above the top of the wall and is mounted to the pair of end members 128. A paddle 132 is slidably mounted on each of bars 130. Paddle 132 includes at one end a cylinder-shaped member 134 that is orthogonal to the flat section 136 of paddle 132. Cylinder member 134 includes an aperture through which Paddle 132 is slidably mounted and is spring loaded on bar 130. In addition to moving up longitudinally along bar 130, paddle 132 can pivot about bar 130 allowing the removal of a stack from the corresponding bin 120. Each bin 120 further includes a lead-in guide plate 140 and a guide surface 142. An urge pulley 144 is sandwiched between guide plate 140, guide surface 142 and transport belt 150. Each bin 120 also has a gate 146 that is actuated by a destination signal from a control system for sorter/stacker 110. Gate 146, when actuated, temporarily intersects transport 122 to thereby divert an envelope from the transport 122 into the bin 120.

Vertical transport system 122 is a dual belt system comprising a plurality of inner belt sections 150 and outer belt sections 152. Inner and outer belt sections 150 and 152 include conventional drive and idler pulleys around which endless elastic belts are stretched. Gates 146 are located between inner belt sections 150, adjacent to the inner reach of outer belt sections 152 and extend parallel to the transport path of vertical transport system 122. Gates 146 pivot at one end about a vertical axis. Each of gates 146 includes a rectangular open section 145 in the non pivoting end through outer belt 152 travels when gate 146 pivots thereto. Outer belt section 152 is shown with multiple belts. In an alternate embodiment (not shown) a single outer belt transport is used in place of multiple outer belt sections 152. The single belt transport includes strategically placed idler pulleys that deflect the mail path to provide lateral force between the belts.

Low abrasive strips 160 are longitudinally fastened to the surface of base plate 124. As is described below, strips 160 must have a low coefficient of friction. In the preferred embodiment of the present invention, strips 160 are made of Delrin AF, manufactured by DuPont of Wilmington, Del. Strips 160 act as the deck of bins 120 as envelopes are stacked into bins 120. Strips 162 of Delrin are also fastened to guide surface 142 to facilitate the registration of an incoming envelope.

With the structure having been disclosed, the operation of sorter/stacker 110 is set forth. An envelope is conveyed to sorter/stacker 110 from the upstream modules 10, 20, 30 and 100. As the envelope is transported on edge by vertical transport system 122, the control system for the sorter/stacker causes a gate 146 of a bin 120 to deflect momentarily toward the adjacent outer belt. This causes the envelope to deflect off gate 146 and follow guide plate 140. The lead edge of the envelope hits the previously stacked envelope (or paddle 132 if the bin is empty) and urge roller 144 urges the envelope between guide surface 142 and the previously stacked envelope until the lead edge of the envelope hits registration wall 126.

Sorter/stacker 110 does not need a mechanism to perform the traditional "stack advance" function. Instead, the entire stacker bin is angulated at a specific angle. This allows gravity to act on the stack of mailpieces being accumulated in the stacker bin and advance the stack as additional pieces enter. There are certain very specific conditions which allow such stacking device to be successful while stacking a great variety of different types of envelopes to stack lengths of 22 inches or greater.

Registration wall 126 is laterally adjustable to handle different size envelopes. The manner by which the vertical registration wall 126 is adjusted can be as simple or as complex as is desired. In the preferred embodiment of the present invention, a simple method to make the registration surface adjustable is to provide multiple sets of lateral slots 170 through which the registration surface can be laterally positioned and secured in a conventional manner. Slots 170 have a length sufficient for registration wall to be positioned over an entire range of desirable positions. An alternate embodiment provides multiple sets of discrete holes that facilitate an easy adjustment of registration wall 126 to several discrete positions for desired "trail edge lengths" of envelopes processed. An alternate and more elaborate means of adjusting the "trail edge lengths" of envelopes in their respective stacker bins is to provide, in addition to slots 170 of the preferred embodiment, a "lead-screw type" of mechanism to offer an easy operator adjustment and infinitely variable placement of the registration wall across all envelope lengths.

A more detailed description of sorter/stacker 110 is provided in U.S. patent applications Ser. No. 08/152,791 previously note as a related application and incorporated herein by reference.

Figure 6:
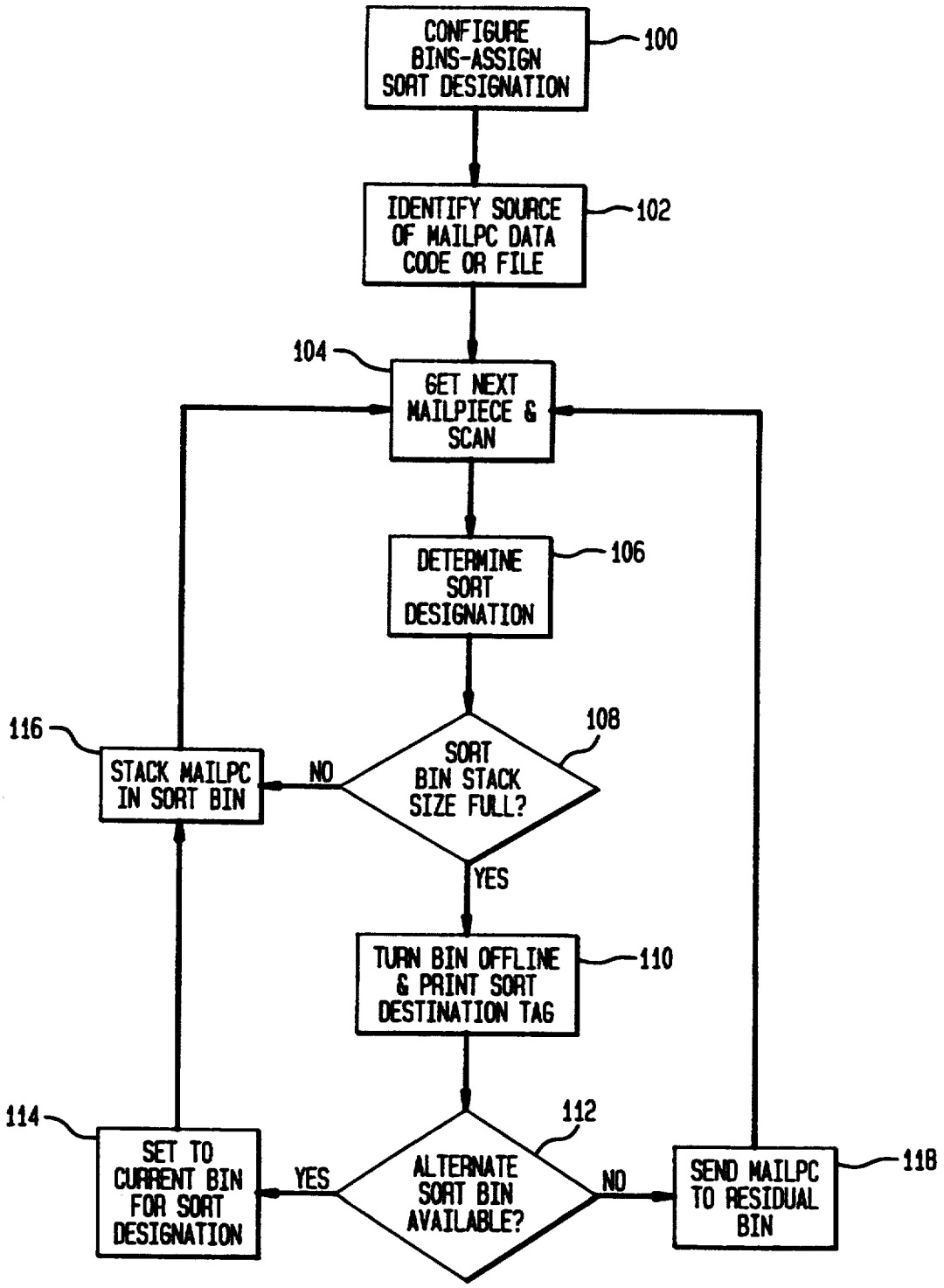
FIG. 6 is a flow chart of the sorting process.

Referring now to FIG. 6, a sorting algorithm performed by the sorter/stacker controller 111 is shown. On the basis of information received from inserter controller 12, sorting bins 120 are configured and assigned for sort designation at step 100. The source for mailpiece data code or file is identified at 102. The mailpiece processing begins at 104 when a mailpiece is scanned. In the preferred embodiment of the present invention, mailpiece information is generally tracked with each mailpiece as it is assembled and processed in the inserter, such that the mailpiece can be sorted with the need for further scanning at sorter/stacker 110. However, the scanning at sorter/stacker 110 serves to improve the integrity of the sorting process by verifying the mailpiece is indeed the mailpiece expected based on the information received from inserter controller 12.

At 106, the sort designation is determined. At 108, the stack size of the bin into which the mailpiece is to be sorted is checked. If the bin is full, then, at 110, the bin is turned off-line, i.e., unavailable for further sorting, and a sort destination tag is printed for the stack in the bin. At, 112, controller 11 determines if an alternate sort bin is available. If there is one, at 114 the alternate sort bin is designated as a current sort bin. At 116, the mailpiece is stacked in the sort bin. If the bin stack size was less than full at 108, then at 116 the mailpiece is stacked in the sort bin and the processing moves on to the next mailpiece at 104. If no alternate sort bin is available at 112, the mailpiece is sent to a residual bin at 118.

It has been found that the present invention provides sorting capability in an inserter based system that previously did not have such capability. The scanner in sorter/stacker 110 not only improves the sorting integrity for inserters that pass mailpiece information to controller 111 of sorter/stacker 110, but also allows sorter/stacker 110 to be used with inserters that do not have the capability to track a mailpiece through the inserter system.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. An inserter based system including automated sorting of mailpieces in accordance with predetermined postal discount requirements, comprising:

an inserter for assembling the mailpieces;

a sorter coupled to said inserter, said sorter including a sorter controller and a plurality of on-edge sorting bins;

means for communicating mailpiece data and configuration data to said sorter controller;

wherein said sorter controller controls the sorting of mailpieces received from said inserter into sort groups according to postal discount requirements.

2. The system of claim 1 further comprising a turn-up and alignment device and a vertical transport located between said inserter and said sorter, said turn-up and alignment device turning the mailpieces from a horizontal alignment out of said inserter to a vertical alignment and said vertical transport transporting the mailpieces on-edge to said sorter.

3. The system of claim 1 wherein said sorter further includes a sort tag printer for printing a sort tag when said sort controller determines that a stack of mailpieces in one of the stacking bins qualifies for a postal discount.

4. The system of claim 1 wherein said sorter further includes a scanner for scanning codes printed on the mailpieces, said sorter controller using data from said scanned codes for sorting the mailpieces to designated sort bins.

5. The system of claim 1 wherein a scanner in said inserter scans codes printed on the mailpieces, said inserter including an inserter controller that sends data obtained from said scanned codes to said sorter controller, said sorter controller using data from said scanned codes for sorting the mailpieces to designated sort bins.

* * * * *